US007774862B2

(12) United States Patent
Bjelland

(10) Patent No.: US 7,774,862 B2
(45) Date of Patent: Aug. 17, 2010

(54) POM-POM POCKET SCARF

(76) Inventor: Hope V. Bjelland, 1111 Ash St., Alexandria, MN (US) 56308

( * ) Notice: Subject to any disclaimer, the term of this patent is extended or adjusted under 35 U.S.C. 154(b) by 1184 days.

(21) Appl. No.: 11/013,672

(22) Filed: Dec. 15, 2004

(65) Prior Publication Data

US 2005/0125878 A1 Jun. 16, 2005

Related U.S. Application Data

(60) Provisional application No. 60/529,928, filed on Dec. 16, 2003.

(51) Int. Cl.
*A42B 5/00* (2006.01)

(52) U.S. Cl. ..... 2/207

(58) Field of Classification Search ..... 2/207, 2/171, 172; 40/129 C, 125 F, 129 A, 125 R, 40/125 G See application file for complete search history.

(56) References Cited

U.S. PATENT DOCUMENTS

| | | | | | |
|---|---|---|---|---|---|
| 129,570 | A | | 7/1872 | Landenberger et al. | |
| 145,977 | A | | 12/1873 | Tuttle | |
| 968,199 | A | | 8/1910 | Schwartz | |
| 1,002,623 | A | | 9/1911 | Adler | |
| 1,072,735 | A | | 9/1913 | Kellner et al. | |
| 1,151,126 | A | | 8/1915 | Robinson | |
| 1,405,744 | A | | 2/1922 | Sampliner | |
| 1,896,060 | A | | 1/1933 | Colby | |
| 1,936,045 | A | * | 11/1933 | Bachrach | 2/91 |
| 2,051,274 | A | | 8/1936 | Rubens | |
| 2,870,448 | A | * | 1/1959 | Rosenthal | 2/91 |
| 3,178,726 | A | | 4/1965 | Gringorten | |
| 3,286,276 | A | * | 11/1966 | Calisch | 2/91 |
| 3,509,580 | A | | 5/1970 | Rubenstein et al. | |
| 4,037,340 | A | * | 7/1977 | Owensmith | 40/586 |
| 4,488,315 | A | * | 12/1984 | Hoerlein | 2/91 |
| 4,894,865 | A | * | 1/1990 | Ieraci | 2/91 |
| 5,072,598 | A | * | 12/1991 | Dibrell | 62/259.3 |
| 5,233,704 | A | * | 8/1993 | Booher | 2/207 |
| 5,720,049 | A | | 2/1998 | Clutton | |
| 5,797,144 | A | * | 8/1998 | Ciccone | 2/144 |
| 5,802,613 | A | | 9/1998 | Marshall | |
| 5,903,924 | A | * | 5/1999 | Garbit | 2/207 |
| D414,528 | S | | 9/1999 | Bocock et al. | |
| 6,748,896 | B2 | * | 6/2004 | Hunsley | 116/173 |
| 2003/0196584 | A1 | * | 10/2003 | Hunsley | 116/173 |
| 2005/0000050 | A1 | * | 1/2005 | Galvin et al. | 15/226 |
| 2005/0039242 | A1 | * | 2/2005 | Edmondson | 2/207 |

FOREIGN PATENT DOCUMENTS

| | | |
|---|---|---|
| FR | 2297577 | 8/1976 |

* cited by examiner

*Primary Examiner*—Shaun R Hurley
*Assistant Examiner*—Andrew W Sutton
(74) *Attorney, Agent, or Firm*—Albert W. Watkins

(57) ABSTRACT

A scarf has hand-receiving pockets at the opposed ends. Adjacent to or on a surface of the pockets are long flaccid strands, fringes, tassels or the like which may be manipulated through hand contact with the scarf body, to be waved about in the manner of cheerleading pom-poms. The flaccid strands are in a preferred method of fabrication cut but not fully severed from sheets of material. The sheets are then stacked together and sewn or otherwise affixed along a single axis. Several rows of sheets may be placed adjacent to each pocket, giving a finished appearance of cheerleading pom-poms. Each sheet may have a color selected from the colors of a team, wherein the pompons will as a collection include all of the team colors.

4 Claims, 3 Drawing Sheets

POM-POM POCKET SCARF

CROSS REFERENCE TO RELATED APPLICATIONS

This application claims priority to U.S. provisional patent application Ser. No. 60/529,928 filed Dec. 16, 2003, the contents which are incorporated herein by reference in entirety.

BACKGROUND OF THE INVENTION

1. Filed of the Invention

This invention pertains generally to apparel, and more particularly to a scarf which includes pockets and pompons.

2. Description of the Related Art

Team events, including but not limited to sporting events, offer a combination of directed and constructive activity, together with a learning or appreciation of human interaction and dynamics.

In order to support and encourage the benefits of the team events, and make the activity enjoyable for both participants and spectators, there have been developed many different garments and other articles which are used to show team participation and spirit. Exemplary of these are such items as letter jackets, cheerleading pom-poms, and various mascot or otherwise related articles such as tomahawks, head dresses and hats, and even "homer hankies". Spectator involvement not only makes the event more enjoyable for the spectators themselves, but also shows support and may rally a team to perform better. This in turn improves the benefit of the activity for all. Furthermore, well after the events, sometimes years later, the various garments and articles will serve as memorabilia, thereby continuing to offer value.

One of the disadvantages of much of the prior art memorabilia is that it must be purchased and carried about as a separate item. For example, the articles such as tomahawks and pom-poms serve no other purpose, and are readily forgotten or misplaced. Storage within a person's home is always difficult, particularly as the articles get larger. Furthermore, in the cases where the event takes place in relatively colder weather, these articles may be very difficult to handle or use. Holding a separate article and waving it about while wearing gloves or mittens may lead to the inadvertent release, which can not only lead to the loss of the memorabilia, but may also incite anger in surrounding spectators who might be exposed to flying articles. Where more manageable articles are used, they frequently lose the benefit of larger, more visible items. One of the benefits of these articles is the ability to encourage a team to rally. With smaller articles, these are much less visible to the team participants. Yet, larger articles are more difficult to carry to and store between events.

Articles of clothing, such as letter jackets and team shirts, help greatly with the use and storage issues. For example, a team jacket may be used whenever the weather is appropriate, and storage already exists for similar articles in people's homes. The same is true for most articles of clothing. However, these articles of clothing do little during the sporting event in terms of encouraging the participants, since it is difficult, if not impossible, to wave about the article of clothing. As a result, the team participants will most generally only see the heads and shoulders of the audience, and their arms if raised.

U.S. Pat. No. 5,903,924 by Garbit, the teachings which are incorporated by reference herein, illustrates a scarf with a pocket at the end of the scarf for an inflatable ball. The ball is used for cheering for a team. The combination scarf and ball presents an advantage over the prior art in the integration of a cheering device together with apparel that is readily stored and brought to an event. However, the ball fails to provide controlled manipulation by the spectator, and so fails to overcome the deficiencies of the prior art with regard to the hazards presented. In other words, the ball at the end of the scarf will be swung about wildly. As those who have tried before will recognize, an object being held at the end of a long flaccid element and being swung thereabout will obtain very substantial velocities, potentially great enough to harm other persons close by.

U.S. Pat. No. 4,488,315 by Hoerlein, the teachings which are incorporated by reference herein, illustrates a scarf with hand puppets at one or both ends, with a construction to allow hand access to manipulate the puppet ends of the muffler. French patent 2,297,577 (FR2297577) by Chambaz et al, the teachings which are incorporated by reference herein, illustrates a bonnet-foulard (hat-scarf), a tubular scarf with round pompons attached to the ends and disclosed for use also as a cap when folded inward upon itself. Other patents of interest, the teachings which are incorporated by reference herein, include U.S. Pat. No. 1,072,735 by Kellner et al; U.S. Pat. No. 3,178,726 by Gringorten; U.S. Pat. No. 2,870,448 by Rosenthal; U.S. Pat. No. 145,977 by Tuttle; U.S. Pat. No. 1,896,060 by Colby; U.S. Pat. No. 2,051,274 by Rubens; U.S. Pat. No. 4,488,372 by Lowen; U.S. Pat. No. 5,720,049 by Clutton; and U.S. Pat. No. Des 414,528 by Bocock et al. Nevertheless, each of these patents fail to disclose a highly visible and well-manipulated cheering aid that may be stored and used in the ordinary manner of apparel.

SUMMARY OF THE INVENTION

In a first manifestation, the invention is an article of apparel consisting of a long narrow body suitable for operatively wrapping around a wearer's neck and operatively coupling to at least one of the wearer's hands. At least one human hand hold is provided adjacent with and coupled to at least one end of the long narrow body. A hand region within the long narrow body is adjacent to a human hand when the hand is operatively coupled through the at least one human hand hold to the long narrow body. Multiple flaccid elements are attached and protruding from the long narrow body adjacent to and substantially along the hand region.

In a second manifestation, the invention is a method of manufacturing a pom-pom scarf. According to the method, a longitudinally extensive body is fabricated which terminates at ends thereof. Hand couplings are formed adjacent the body ends. At least one layer of multiple flaccid elements are applied adjacent the hand couplings, and extend substantially from body ends along and adjacent to the hand couplings.

In a third manifestation, the invention is a pom-pom scarf having a long textile body. A pair of pockets terminate the long body. Each of the pockets has at least one opening sized to fit a wearer's hand. Strips of cloth are affixed to and project from the textile body between pocket openings and opposed ends of the long textile body.

OBJECTS OF THE INVENTION

Exemplary embodiments of the present invention solve inadequacies of the prior art by providing a scarf having hand-receiving pockets at the opposed ends. Adjacent to or on a surface of the pockets are long flaccid strands, fringes, tassels or the like which may be manipulated through hand contact with the scarf body to be waved about in the manner of cheerleading pom-poms. When not in use for cheering, the pompons have the appearance of tasteful tassels.

A first object of the invention is the provision of an article of apparel which has excellent utility and appearance. A second object of the invention is to provide in combination with utility and appearance an apparatus which is readily manipulated for the rallying of a team. Another object of the present invention is the provision of a method of manufacture which provides the foregoing and other objects with minimal cost and complexity. A further object of the invention is to provide such an article which may readily be produced in the custom colors of a particular team, without requiring prohibitive inventory or production expense.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
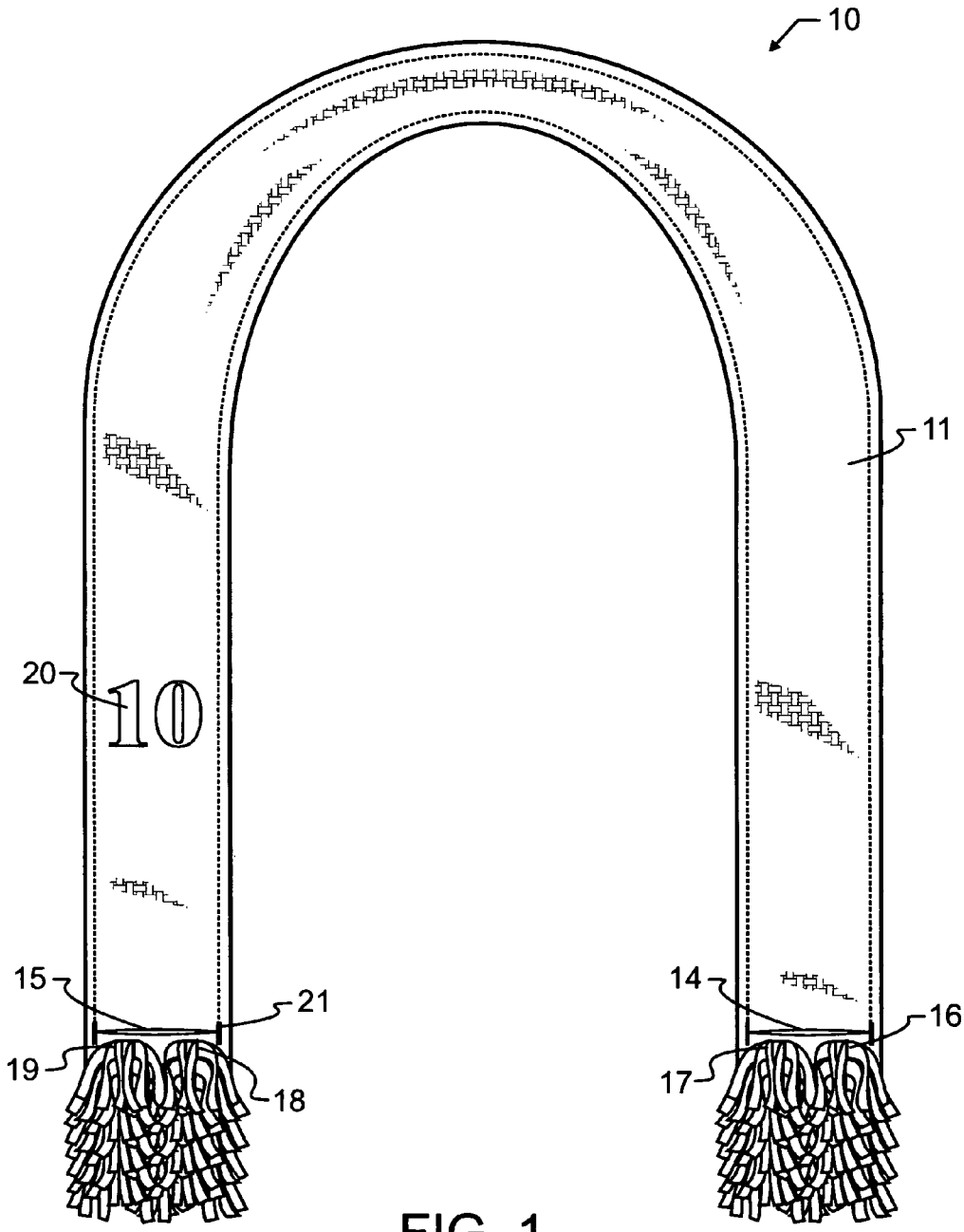
FIG. 1 illustrates a preferred embodiment pom-pom scarf designed in accord with the teachings of the present invention, from a front view as it would be worn upon a person.
Figure 2:
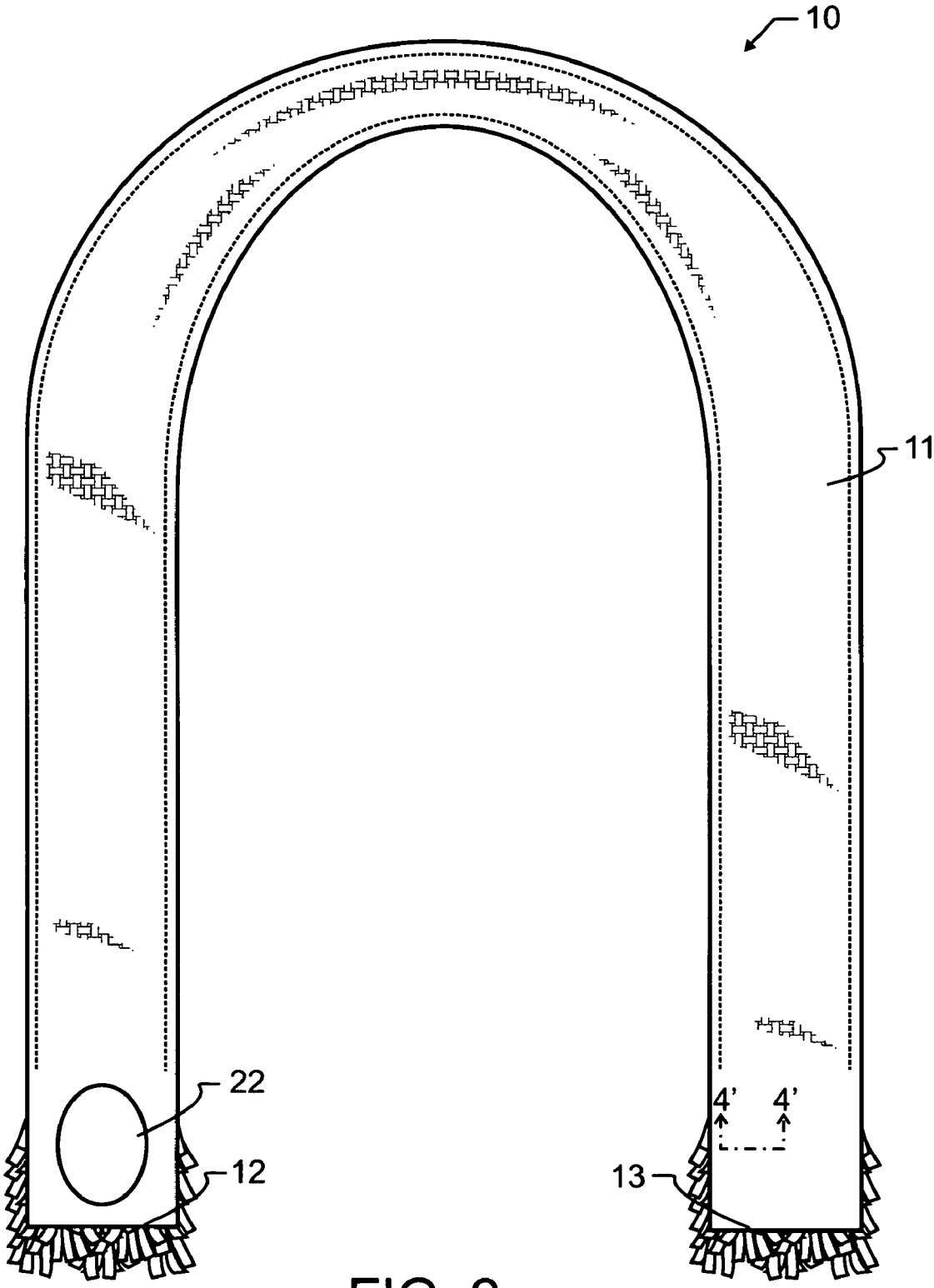
FIG. 2 illustrates the preferred embodiment pom-pom scarf of FIG. 1 from a back view.
Figure 4:
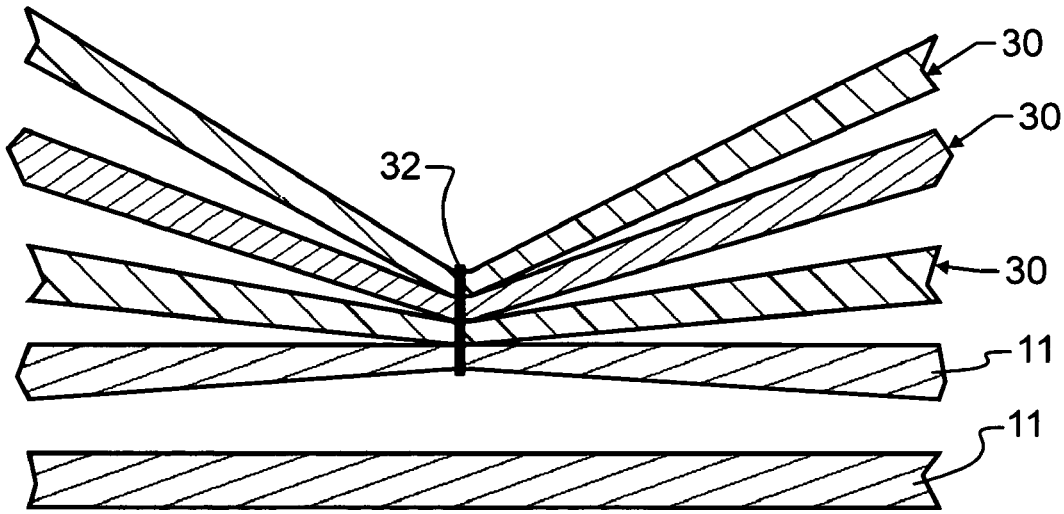
FIG. 4 illustrates the hand region of the preferred embodiment pom-pom scarf of FIG. 1 by cross-sectional view taken along line 4' of FIG. 2.

In a most preferred embodiment, scarf 10, which is illustrated in FIGS. 1, 2 and 4, has been designed in accord with the teachings of the present invention and is exemplary thereof. A flaccid, indeterminate length body 11 terminates at a first end 12 and second end 13 visible in FIG. 2. Body 11 will most preferably be formed from any suitable composition which will preferably provide a suitable combination of warmth and comfort. While textiles are most preferred and generally accepted, those skilled in the art will recognize that other compounds and compositions may be formed into a suitable body shape. Furthermore, any of a wide variety of weaves or non-woven materials may also be used. An exemplary material which provides the combination of comfort and warmth most preferred in the present embodiment is polar fleece, though those familiar with scarves will understand and recognize the many diverse materials which might alternatively be used herein.

In this preferred embodiment, body 11 is formed into a tube, such as by stitching a single seam extending longitudinally. Ends 12, 13 will preferably comprise closed ends of this tube, which may be achieved by stitching, bonding, or other suitable technique. Adjacent ends 12, 13 are pocket openings 14, 15, respectively, which in the preferred embodiment are cuts passing through the material and which extend approximately one-third of the circumference of the tube which comprises body 11. This permits a person to insert their hand therein, and be surrounded by warm and comfortable material. Where appropriate, reinforcement such as stitching 21 may be provided, best visible in FIG. 1, to ensure the body 11 material does not unreasonably tear or stretch at the terminus of each pocket opening 14, 15. Where appropriate or desired, similar reinforcement may be provided completely around pocket openings 14, 15, and may alternatively be provided through the incorporation of other material or fabrics including but not limited to interfacing, seam tape, bias tape, or the myriad of other materials and techniques.

The use of fleece or other reasonably solid or contiguous material in the fabrication of body 11, as opposed to the sometimes more open meshes such as crocheted or knit yarns, permits pocket openings 14, 15 to not only serve as hand receivers, but will also permit other objects to be carried therein. While not limited thereto, such objects will normally be contemplated to be either of limited size or quantity or weight, and might, for exemplary purposes only and not limited thereto, include such commodities as lip balms, stadium tickets, or even chemical or electrical hand warmers. Nevertheless, and as will be understood in the discussions of the preferred method of use illustrated in FIGS. 3 and 4 herein below, the use of pocket openings 14, 15 in association with ends 12, 13 as pockets for storing goods is considered to be of ancillary benefit.

While, in the preferred embodiment, body 11 is fabricated as a tube with closed ends 12, 13, many alternatives are contemplated herein. Exemplary, though not limiting, is the use of a planar web, which will then have the ends wrapped back upon the web. The sides of overlap would then, in this alternative embodiment, be stitched or otherwise attached and possibly sealed to form pocket openings 14, 15 with a naturally closed bottom, stitched sides, and open top for receiving a hand therein. The attachment of pom-poms would then remain the same. In a second alternative embodiment, pocket openings 14, 15 may be shaped to take a form resembling mittens or gloves. In an even further alternative, mittens or gloves may be provided simply by anchoring or attaching directly within the pockets, though such an approach is believed herein to undesirably increase the cost while also being somewhat more restrictive in both suitable materials and in acceptable hand sizes.

Extending substantially between pocket openings 14, 15 and ends 12, 13 and on an exterior of body 11 are several pompons 16-19, the exact number not being critical to the performance of the invention. In the preferred embodiment, these may also be fabricated from polar fleece, though once again others of a myriad of materials may be selected for certain desirable characteristic. In this preferred embodiment, each pompon 16-19 may be fabricated from a plurality of colors, which may preferably match the colors of a particular sports or other team. At any suitable location upon body 11 may be provided one or more insignia 20, which will be understood to include, but not be solely limited to, numbers, photos, buttons, badges, or any other suitable decorations or the like.

FIG. 2 illustrates the optional incorporation of a noise-generating patch 22, which may, for exemplary purposes, be fabricated from a plastic, leather or other material. Patch 22 is provided to enable a wearer to generate substantial noise, preferably through though not solely limited to motion similar to that used with ordinary bare hands to produce a clapping sound. With suitable material selection, a variety of sounds may be produced ranging from gentle and slightly muffled clapping to very loud and obtrusive sounds even so extreme as to be produced by symbols.

Figure 3:
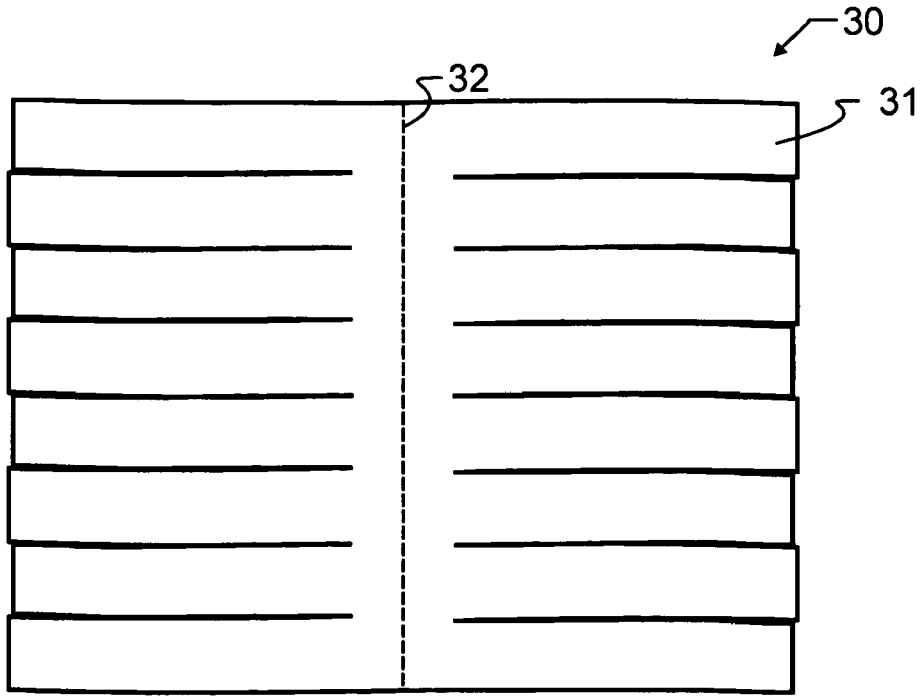
FIG. 3 illustrates a preferred single layer of fringes used in the preferred embodiment pom-pom scarf of FIG. 1.

FIG. 3 illustrates the preferred method of fabricating pompons 16-19, by using a sheet 30 of fabric. In the preferred embodiment, sheet 30 is cut to have a plurality of almost severed flaccid elements 31, formed about both sides of a central line 32. One or more of these pre-cut sheets 30 are then stacked adjacent the hand region of scarf 10, adjacent to and extending substantially between pocket openings 14, 15 and ends 12, 13, and then sewn or otherwise affixed along central line 32 thereto. As may best be seen in FIG. 1, the natural tendency for flaccid elements 31 to droop or flop according to the orientation of scarf 10 helps to conceal the central lines 32. However, since these pompons 16-19 are attached adjacent to the pockets and a wearer's hands, they may be readily controlled as desired by the person, while such wearer keeps their hands protected from the elements. Placement of pompons 16-19 in this position will also cause preferred pocket opening 15 to be somewhat spread prior to receiving a hand therein, thereby simplifying the insertion of hands therein.

Owing to the length of body 11, scarf 10 will most preferably rest upon a person's shoulders whether being used in the manner of pom-poms or not, and will be available for desirable warmth and bundling in cold weather. When appropriate, pompons 16-19 may be waved at a moment's notice. Consequently, there is nothing extra to be carried to a sporting event, nor anything to be lost to be able to display and manipulate pom-poms in team decor.

As aforementioned, the specific material used in the fabrication of scarf 10 may vary, though special benefits are attainable if several important factors are taken into consideration. Firstly, scarf 10 should be sufficiently light to be readily carried or worn upon a person's body without burden. Furthermore, it is preferable that scarf 10 have sufficient insulating property to offer protection from cold weather. Most preferably, scarf 10 will also be weather resistant and sufficiently durable to withstand the vagaries of weather and use, including any forces that may be applied during use that could otherwise damage scarf 10 or any of the components therein. As also discussed herein above, special benefit is further attained if the material is solid or of tight weave in the transport of small items.

A variety of designs and colors have been contemplated for scarf 10, including the aforementioned color variations and insignia or decoration 20 detailed herein above. However, in addition to the basic pattern illustrated herein, the present invention contemplates many different artistic and ornamental appearances as well, including but not limited to geometries designed to simulate animals, creatures, fantasy or human figures, and other thematic displays as may be desired for a given situation or application. Team mascots, or the appearance thereof, may further be simulated through construction of patterns or coloring. The materials used for a particular design may be chosen not only based upon the aforementioned factors such as comfort, warmth, weather resistance and weight, but may also factor in the particular design. A particular amount of authenticity may thereby be attained which would otherwise be unattainable with other materials.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A pom-pom pocket scarf having a long textile body, comprising:

first and second pockets extending first and second predetermined distances, respectively, along and less than a longitudinal length of said long textile body, said first pocket adjacent a first end of said long body and said second pocket adjacent a second end of said long body distal to said first end, each of said first and second pockets having at least one opening sized to fit a wearer's hand, said first and second predetermined distances each sufficient to accommodate said wearer's hand;

the first and second pockets include patch of plastic or leather located on the back surface of the pocket for generating noise;

at least one strip of cloth affixed to a surface of said long textile body co-extensive with said first pocket, said at least one strip of cloth having a plurality of flaccid elements projecting from said long textile body substantially throughout said first predetermined distance and thereby forming a pompon;

at least one strip of cloth affixed to a surface of said long textile body co-extensive with said second pocket and having a plurality of flaccid elements projecting from said long textile body substantially throughout said second predetermined distance and thereby forming a second pompon; and a seam affixing said strips of cloth to said long textile body, said seam approximately parallel with a long axis of said textile body when said textile body is laid straight.

2. The pom-pom scarf of claim 1, wherein multiple layers of said strips of cloth add bulk outwardly from said textile body, said strips of cloth providing a mass of flaccid strip ends which move based upon the wearer's hand movements.

3. The pom-pom scarf of claim 1, wherein said strips of cloth further comprise colors, said colors of said strips of cloth and a color of said long textile body chosen to match colors of a team.

4. The pom-pom scarf of claim 1, wherein, said first pocket terminates said long body at a first end of said long body and said second pocket terminates said long body at a second end of said long body distal to said first end.

* * * * *